US007661737B2

(12) United States Patent
St. Germain

(10) Patent No.: US 7,661,737 B2
(45) Date of Patent: Feb. 16, 2010

(54) SLING WITH PREDICTABLE PRE-FAILURE WARNING INDICATOR

(75) Inventor: Dennis St. Germain, Chadds Ford, PA (US)

(73) Assignee: Slingmax, Inc., Aston, PA (US)

( * ) Notice: Subject to any disclaimer, the term of this patent is extended or adjusted under 35 U.S.C. 154(b) by 678 days.

(21) Appl. No.: 11/418,597

(22) Filed: May 5, 2006

(65) Prior Publication Data

US 2006/0261617 A1 Nov. 23, 2006

Related U.S. Application Data

(60) Provisional application No. 60/683,987, filed on May 23, 2005.

(51) Int. Cl.
*B66C 1/12* (2006.01)

(52) U.S. Cl. ..... 294/74

(58) Field of Classification Search ..... 294/74
See application file for complete search history.

(56) References Cited

U.S. PATENT DOCUMENTS

| | | | | | |
|---|---|---|---|---|---|
| 3,077,178 | A | * | 2/1963 | Gordon | 116/212 |
| 3,463,534 | A | * | 8/1969 | Norton | 294/74 |
| 3,885,428 | A | * | 5/1975 | Dalferth | 73/862.53 |
| 3,958,455 | A | * | 5/1976 | Russell | 73/862.68 |
| 4,605,571 | A | | 8/1986 | Watanabe et al. | |
| 4,757,719 | A | * | 7/1988 | Franke | 73/862.56 |
| 4,850,629 | A | | 7/1989 | St. Germain | 294/74 |
| 4,958,853 | A | | 9/1990 | Doty | 280/801 |
| 4,992,778 | A | * | 2/1991 | McKeen et al. | 116/DIG. 34 |
| 5,498,047 | A | | 3/1996 | Treuling | |
| 5,561,973 | A | | 10/1996 | St. Germain | 57/22 |
| 5,605,035 | A | * | 2/1997 | Pethrick et al. | 57/200 |
| 5,651,572 | A | | 7/1997 | St. Germain | 294/74 |
| 5,651,573 | A | | 7/1997 | St. Germain | 294/74 |
| 5,727,833 | A | | 3/1998 | Coe | 294/74 |
| 6,144,301 | A | | 11/2000 | Frieden | 340/572.8 |
| 7,032,466 | B2 | * | 4/2006 | McCauley | 73/862.53 |
| 2004/0094981 | A1 | | 5/2004 | Hess et al. | 294/74 |
| 2005/0011344 | A1 | | 1/2005 | Hess | 87/5 |
| 2005/0062303 | A1 | | 3/2005 | Hess | 294/74 |
| 2005/0093317 | A1 | | 5/2005 | Hess | 294/68.3 |

FOREIGN PATENT DOCUMENTS

| | | |
|---|---|---|
| DE | 2053832 | 11/1970 |

* cited by examiner

*Primary Examiner*—Paul T Chin
(74) *Attorney, Agent, or Firm*—Mark A. Garzia, Esq.; Law Offices of Mark A. Garzia, P.C.

(57) ABSTRACT

A pre-failure warning indicator is provided for use with a sling. The pre-failure warning indicator triggers at a point that is predictable within a relatively narrow range, thereby increasing the possibility that a damaged sling is removed from use. The pre-failure warning indicator includes a dedicated strand of material that is placed in close proximity to the load-bearing core yarns of the sling but remains separate and independent from the core yarns; the ends of the dedicated strand are connected via a sacrificial "ring." A warning fiber having an end that is visible to operators/riggers works in conjunction with the sacrificial strand and the ring. The ring is designed to fail when the sling is subjected to a specifically chosen condition (e.g., excessive weight). The failure of the ring causes the warning fiber to withdraw from the rigger's view thereby warning the rigger that the sling was subjected to the specifically chosen condition and may be damaged.

15 Claims, 4 Drawing Sheets

SLING WITH PREDICTABLE PRE-FAILURE WARNING INDICATOR

CROSS-REFERENCE TO RELATED APPLICATION

The present application claims the benefit under any applicable U.S. statute, including 35 U.S.C. § 119(e), to U.S. Provisional Application No. 60/683,987 filed May 23, 2005, in the name of Dennis St. Germain, titled Sling Having Predictable Pre-Failure Warning Indicator and Associated Method.

This application incorporates by reference U.S. Provisional Application No. 60/683,987 as if fully set forth herein.

FIELD OF THE INVENTION

This invention relates generally to industrial slings used to lift, move and transport heavy loads and, more particularly, an apparatus for notifying operators/riggers who use synthetic slings of an overload or damage situation that may lead to sling failure.

BACKGROUND OF THE INVENTION

Wire rope slings made of a plurality of metal strands twisted together and secured by large metal sleeves or collars are common in the industry. During the past thirty years, industrial metal slings have seen improvements in flexibility and strength. However, compared to non-metal or synthetic fiber slings, metal slings are relatively stiff and inflexible.

Synthetic fiber slings have gained popularity over the last fifteen years and are replacing metal slings in many circumstances. Synthetic slings are usually comprised of a lifting core made of twisted strands of synthetic fiber and an outer cover that protects the core. The most popular design of synthetic slings is a roundsling in which the lifting core forms a continuous loop and the sling has a circular or oval-shaped appearance.

An advantage of synthetic slings is that they have a very high load-lifting performance strength-to-weight ratio which provides for a lighter, more flexible and even stronger slings than their heavier and bulkier metal counterparts. Even with such advances in the art of sling making, the riggers who use these improved synthetic slings still suffer and endure some of the age old problems of sudden failure and loss of a load caused by a sling breaking without warning because it was fatigued (or overly stretched) from being subjected previously to overload conditions. After a sling has been fatigued, it does not usually provide any physical indication that it was damaged—even to the trained eye. (One of the few advantages of a metal sling over a non-metal sling is that there is equipment available that can be used to conduct a non-destructive test of the metal. For example, similar equipment is routinely used to determine whether the wings of an airplane have become fatigued.)

Standard break tests have been established for determining how large of a load a sling can endure. Slings are attached to a testing machine that applies a steady but increasing force on the sling until it is unable to withstand the stress of the force being applied to it and the sling ultimately breaks. Such break tests have enabled manufacturers of industrial slings to rate the load-bearing capacity of the sling. The load capacity is determined to be a point well below the load used to break the sling and also below the point where the sling is fatigued or damaged. Most sling manufacturers will affix some type of tag notice on the sling which states the load capacity (rated capacity) of the particular sling. This rated capacity gives the maximum amount of load to which the sling may be subjected and still be considered a safe use of the sling.

Unfortunately, even conscientious operators/riggers who do not take unsafe shortcuts and who operate in a safe responsible manner sometimes are surprised by a sling breaking in use even when they believed it was being used within the load limits of its rated capacity. For example, when industrial slings are in continuous heavy use over three shifts around the clock, the operators on a later shift may not be aware that someone on an earlier shift had subjected the sling to a substantial overload which may have caused serious damage to the lifting core strands of the sling. When a synthetic fiber sling is overloaded beyond its tensile strength or weight-lifting capacity at maximum stretch, it is considered to be fatigued and may never return to its normal strength and load bearing capacity.

When subjected to an overload condition above its rated capacity, a roundsling can be permanently damaged/deformed if the load stretches the fibers of the load bearing core material beyond their yield point. An over-loaded sling may be susceptible to fracture at a stress point. This condition is similar to the stretching of a rubber band beyond its point of normal elasticity so that when the load or tension is removed or relieved, the rubber band will never regain its normal configuration and its strand dimensions may be permanently stretched which will cause it to fail under a load which is less than its tensile strength load. As stated previously, it is nearly impossible to determine, upon a cursory visual inspection, that a sling has been damaged because of the large size of such slings (on the order of 6 feet or more) and because the load-bearing core is hidden inside the outer cover.

Once the load-lifting core of the synthetic sling is stretched beyond its yield point, it can actually change in its physical structure and be restricted at a stress point. To date, there has been no precise method or apparatus available to an operator or rigger to determine if a sling with a protective cover was subjected to an overload or damage-causing condition. If a roundsling has been fatigued or structurally changed, the sling may no longer lift a load according to its maximum rated load capacity and, most importantly, becomes a serious threat to the operators and riggers using the sling.

Thousands of roundslings are being used on a daily basis in a broad variety of heavy load lifting applications which range from ordinary construction (e.g., skyscrapers and bridges), plant and equipment operations, to ship building (e.g., oil rigs), nuclear power plants and the like. The lifting core fibers of such roundslings may be derived from natural or synthetic materials, such as polyester, polyethylene, nylon, and the like. Although the outer covers of synthetic slings are designed to reduce damage, the core fibers are still susceptible to damage from abrasion, cutting by sharp edges, or degradation from exposure to heat, cold, ultraviolet rays, corrosive chemicals or gaseous materials, or other environmental pollutants.

In certain instances, the core yarn of a synthetic sling could weaken, melt or disintegrate when subjected to elevated temperatures, or to prolonged exposure to either ultraviolet light or chemicals. Still another safety concern flows from abuse by the user when the core yarn is damaged from abrasive wear when the slings are not rotated and the same wear points are permitted to stay in contact for extended periods of time with a device used for lifting (such as hooks on a crane), or on the edges of the load itself. Such abrasion is accelerated for certain types of synthetic fiber material and especially if the load contact section is under compression or is bunched. Riggers in the field are concerned that the inner lifting core yarn of their roundslings may be damaged on the inside without a means for them to detect such defects through the sling cover. Even if the cover is removed it may be impossible to tell if the lifting core has been damaged to the point where it cannot lift its rated load. Since there is no reasonable non-destructive testing techniques for synthetic fiber slings, a synthetic sling that is only suspected of being damaged must be removed from service for safety reasons.

The structural integrity of the roundsling lifting core material is difficult to determine when it is hidden inside a protective cover of opaque material which renders the lifting core yarn inaccessible for inspection. A stretched or fatigued roundsling could experience a sudden catastrophic failure without warning to the rigger, which may result in the loss of lives and property. Many in the industry have sought to provide safe slings to its riggers to avoid bodily injury, property damage and product liability claims.

Several roundsling constructions are known which have a failure indicator. For example, it is known in the art to incorporate a failure indicator synthetic strand as an integral member of the lifting or load-bearing core. The failure indicator strand in prior art constructions was always an extension of the core yarns.

A popular design of prior art roundslings was to twist a plurality of yarns together to form a single strand; the strand is then rolled into an endless parallel loops of strands that form the core, which is then encased in a protective cover material. If the sling was designed with a prior art failure indicator, an indicator strand would be incorporated into and twisted with the core yarns. The two ends of the indicator strand (sometimes referred to as tell-tails), extend freely through an opening in the cover material. When the sling is subjected to an overload condition, the tell-tail would partially withdraw within the cover and the freely extending tell-tail ends would be visibly shorter than the tell-tails of an undamaged sling; if the overload condition exceeded the maximum rated load of the sling, one or both tell-tails would usually withdraw completely within the cover. In either event, the rigger is warned of the occurrence of a potentially damaged sling by either the absence of one or both tell-tails, or a "significant" withdraw of at least one tell-tail inside the cover. However, there usually was no consistency on how the tell-tails would react when triggered, even when the slings were manufactured under identical conditions.

A drawback of prior art failure indicators based on an indicator strand is that there is no predictable way of determining when the failure indicator will be triggered. Synthetic slings have a safety factor designed into their construction. For example, if the sling is rated at 6,000 pounds, it typically will not be damaged unless the sling is subjected to a force five times greater (i.e., around 30,000 pounds, a 5-to-1 design factor) than the rated capacity; the tell-tail may be triggered and indicate an overload condition when the sling is subject to a force of between four to five times the rated capacity (i.e., about 24,000 lbs) by retracting into the sling's cover. Therefore, the tell-tail will provide a visual indication that the sling may have been damaged or subjected to a situation that may have been detrimental to the overall condition of the sling before the sling actually is subjected to such a condition. Unfortunately, there was no way of ensuring that the tell-tails would consistently withdraw within the cover at about 24,000 pounds.

In other words, two slings having prior art failure indicator strands contemporaneously made under the same conditions would have two different trigger points (for example, one sling may trigger at about 22,050 pounds and the other sling may trigger at about 26,000 pounds). In addition, one sling may react to a trigger event by completely withdrawing one of the tell-tails, while the other sling may react to a trigger event by partially withdrawing both tell-tails.

If the tell-tail is not withdrawn completely within the cover, one rigger's opinion of a "significant withdrawal" towards the opening in the cover may differ from another rigger's opinion. Therefore, a "small" movement of one or both of the tell-tails, which may result from the constant use and handling of the sling, may appear to one rigger as an indication that an overload condition was reached when, in fact, the sling was not subjected to an overload condition. Therefore, the visual inspection of the tell-tails in prior art failure indicators and the eventual determination of a trigger event becomes a subjective test.

Another prior art roundsling construction utilizes an optical fiber strand that enables the operator/rigger to test it by shining a light on one end of the optical fiber to determine if the light can be seen at the other end of the optical fiber. In U.S. Pat. No. 5,651,572 to Dennis St. Germain, it is taught to incorporate a flexible fiber optic "signal" cable into the lifting core strands of the roundsling.

As indicated previously, in a roundsling, the lifting core is configured in endless parallel loops of strands which are then encased within a protective cover material. The cover will have openings or orifice slits out of which the two ends of the fiber optic signal strand emerge. The aforesaid ends of the fiber optic cable are designed to extend freely through a slit in the sling's cover so that they are easily accessible by the rigger.

The optical signal strand member conducts light from a light source at one end to an observer looking at the opposite end for testing the integrity and the continuity of the core strands. The inclusion of the fiber optic cable in the lifting core yarn of the roundsling converts the inaccessible inner core area into an observable test check area by means of the passage of light through the fiber optic component of the lifting core.

Fiber optic materials are capable of transmitting light into endless parallel relationship with the fibers of the lifting core yarn. This fiber optic signal strand comprises fiber or rod material which permits the propagation of light that enters the fiber material at one end and is totally reflected back inward repeatedly from the fiber wall through the entire length of the fiber optic strand which enables the light being transmitted within the fiber optic cable to pass from one end of the fiber optic cable to the other end. If the light emerges at the other end of the fiber optic cable, it indicates that the integrity of the fiber optic cable throughout the path of the roundsling lifting core bundle is intact and, by reasoning, the integrity of the lifting core yarns are also intact.

Since the fiber optic cable member is incorporated into the lifting core of the roundsling disclosed in U.S. Pat. No. 5,651,572, it tends to develop somewhat similar breaking or snapping characteristics as the lifting core fiber materials. If the fibers of lifting core yarn break or fracture, then the fiber optic cable will also be damaged which will prevent the transmission of light from one end to the other end of the emerging fiber optic cable. If the light fails to pass from one end of the signal fiber optic cable to the other end, then the rigger is warned that the lifting core strands may be damaged, and to remove the protective cover from the roundsling for further inspection. If, upon inspection, it is determined that the roundsling was damaged, it will be immediately removed from service, and replaced with a new sling.

Although the apparatus disclosed in U.S. Pat. No. 5,651,572 is currently the leading product for determining whether the lifting core yarns of a synthetic sling have snapped or been damaged, in the stages where the sling has been subjected to an overload condition, the fiber optic signal strand still does not have the identical stretching properties of the load-bearing core yarns. Accordingly, unless the fiber optic cable breaks completely, some light may still be able to traverse the entire length of the fiber optic cable such that the degradation in the intensity of the light may be imperceptible to the naked eye.

Alternatively, the fiber optic cable, being more brittle than the synthetic core material, may be damaged by normal handling (and dropping) of the sling, or at a force less than the rated capacity of the sling. In such cases, the light transmission through the fiber optic cable may be disrupted causing the fiber optic cable to indicate an overload condition when, in fact, no overload condition was reached.

Finally, under other excessive or damage-causing situations (e.g., excessive heat, acidic or chemical exposure, and ultraviolet exposure) it can be expected that the fiber optic cable will be affected differently than the synthetic strands of the lifting core. If, for example, a sling with the fiber optic signal cable is exposed to certain chemicals, the fiber optic signal cable may be relatively unaffected (or only its exterior surface is affected leaving the light path through the center of the cable unscathed), while the lifting core has been degraded to the point where it no longer meets its load rating. Therefore, as stated previously, the need to precisely determine whether the load bearing core of a synthetic sling was subjected to an excessive or damage-causing situation still exists.

SUMMARY OF THE INVENTION

The present invention discloses a pre-failure warning indicator for use with a sling that is more accurate and predictable than prior art indicators. In the present invention, the failure indicator strand is separate and independent from the load-bearing core yarns.

One of the most popular designs of a roundsling is to twist a plurality of yarns together to form a single strand; the strand is then rolled into endless parallel loops of strands that form the core. In accordance with the present invention, a pre-failure warning indicator includes a separate dedicated strand of material, a ring made of a specially chosen material, and a separate warning fiber having an elongated indicator whip end.

The dedicated strand is placed proximate and substantially parallel to the loops of core strands of the sling; the ends of the dedicated strand are brought within close proximity (in a preferred embodiment several inches) to each other and are terminated with eyes or another configuration that can secure the ring. The ring is inserted through or secured to both eye terminations, thereby bridging the gap between the ends of the dedicated strand, and usually forms an oval-shaped loop. One end of the warning fiber is attached to one of the eyes of the dedicated strand, and the free end of the warning fiber is placed along the ring and threaded through the opposite eye; the free end of the warning fiber is then double-backed along the length of the ring. A tubular cover material encases the lifting core and the pre-failure warning indicator. The free end of the warning fiber extends through an opening in the cover material and is referred to as the indicator whip.

In a specific embodiment, a tag is attached to the strand (and preferably one of the terminating eyes) and is also drawn through the slot so that it extends freely outside the cover. The tag is designed to provide an indicator that the sling has been tampered with or sabotaged.

The ring is designed to fail when the sling is subjected to an excessive or damage-causing situation. A common damage-causing situation is when the sling is over-loaded. The ring will break when the sling is placed in an overload situation, thereby causing the termination eyes to separate, resulting in the complete withdrawal of the whip inside of the cover.

By choosing the ring carefully, relatively accurate predictions of the force needed to trigger the warning fiber can be made. In addition, the ring may be chosen to fail and thereby convey a damage situation when the sling is being used under unusual environmental conditions (e.g., excessively hot, acidic, or ultraviolet rays from, for example, sunlight).

Previous indicators either of the fiber optic nature or of the tell-tail type could give false indications of an overload or other internal damage. In the case of fiber optics, the ability to transmit light can be impeded by dirt, grease, and other debris that can retard the transmission of light through the fiber optic cable by jamming the ends. In the case of tell-tails, the movement of the sling's outer cover from friction with a load can give a false implication that the tell-tails were pulling under the cover when it was really the cover moving over the tell-tails. In the current invention, these areas of confusion are eliminated by a simple visual identification of the external warning indicator. Also, the dedicated strand can be locked into place by permanent attachment to the cover. If the cover shifts, the entire assembly of this invention moves with it in concert so a false indication of overload is eliminated.

Additional objects and advantages will be evident to one skilled in the art after a reading of the detailed description that follows.

BRIEF DESCRIPTION OF THE DRAWINGS

The accompanying drawings, which are incorporated in and form a part of the specification, illustrate the embodiments of the present invention and, together with the following description, serve to explain the principles of the invention. For the purpose of illustrating the invention, there are shown in the drawings embodiments which are presently preferred, it being understood, however, that the invention is not limited to the specific instrumentality or the precise arrangement of elements or process steps disclosed.

In the drawings.

DETAILED DESCRIPTION OF THE PREFERRED EMBODIMENT

Figure 1:
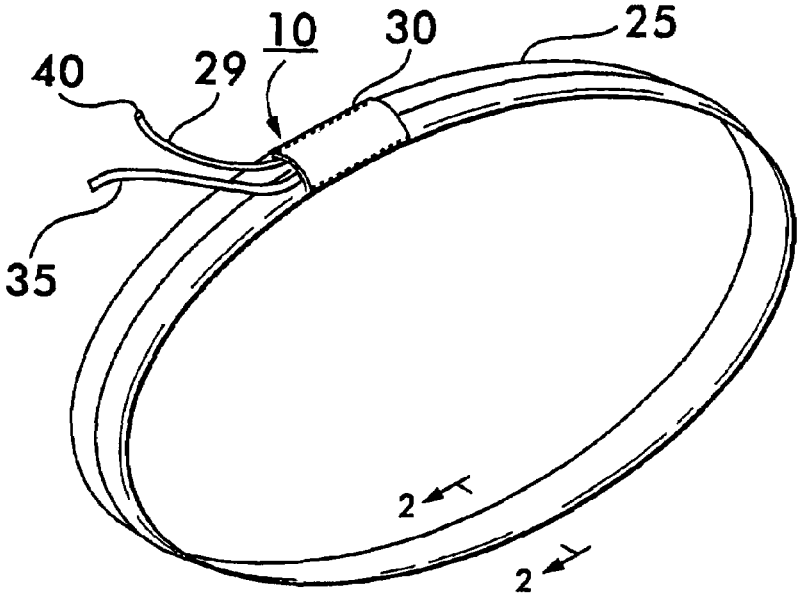
FIG. 1 is a perspective view of a single-path roundsling which incorporates a predictable pre-failure warning indicator in accordance with the present invention.

In describing a preferred embodiment of the invention, specific terminology will be selected for the sake of clarity.

However, the invention is not intended to be limited to the specific terms so selected, and it is to be understood that each specific term includes all technical equivalents that operate in a similar manner to accomplish a similar purpose.

The subject invention is an apparatus and method for determining whether a synthetic fiber sling has been damaged (because of an overload or other condition that could weaken the sling's load-bearing core) to a point where the sling should be removed from service and returned to the manufacturer for internal inspection and, if necessary, repair or disposal. Preferred embodiments of the present invention will now be described in detail with reference to the accompanying drawings in which a roundsling having a pre-warning failure indicator in accordance with the present invention is generally indicated at 10. The various preferred embodiments will be described with reference to the drawing figures that form a part of this description where like numerals represent like elements throughout.

Figure 2:
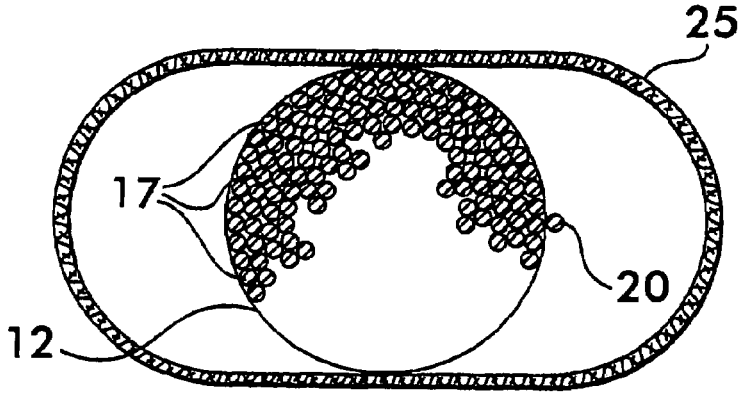
FIG. 2 is an enlarged cross-sectional view of the roundsling illustrated in FIG. 1 taken along line 2-2.

FIG. 1 illustrates a perspective view of a roundsling in accordance with the present invention. FIG. 1 specifically shows a single-path roundsling, but the principles disclosed herein may be applied to other slings including multiple-path slings. FIG. 2 is a cross-sectional view of the roundsling shown in FIG. 1 taken along line 2-2, and illustrates the primary interior components of a typical roundsling.

Referring to FIGS. 1 and 2, the roundsling 10 comprises an inner core 12 encased within an outer protective cover 25. The outer cover 25 shown in FIG. 2 is meant to convey that the cover 25 is larger than the load-bearing core 12 and moves relatively freely with respect to the load-bearing core 12 and not necessarily that the cover 25 has a cross-sectional shape of an oval. The core 12 is designed to bear the entire weight of the load to be lifted. The primary purpose of the outer cover 25 is to prevent physical damage to the core from abrasion, sharp edges on the load, etc.; the cover 25 will also help to reduce damage to the sling when it is used in an environment that will subject it to harsh elements such as heat, ultraviolet light, corrosive chemicals, gaseous materials, or other environmental pollutants. As will be explained hereinafter, the cover 25 can also be designed to notify a user when physical damage has occurred to the cover.

The lifting core 12 is preferably made of a single or multiple strands 17 configured in a plurality of endless parallel loops of strands to form a single core or multiple cores, all of which are contained inside the protective cover material 25. The use of a single strand or multiple strands in this configuration is typical in the construction of roundslings.

The lifting core 12 of such roundslings may be derived from one or more natural or synthetic materials, such as polyester, polyethylene, nylon, K-Spec® (a proprietary blend of fibers), HMPE, LCP, para-aramid or other types of synthetics. The material chosen for the core primarily depends on the maximum weight the sling is designed to lift and environment in which the sling 10 will be used. Such sling constructions have a high lifting and break strength, lighter weight, high temperature resistance and high durability, compared to wire rope or metal chain slings.

Figure 3:
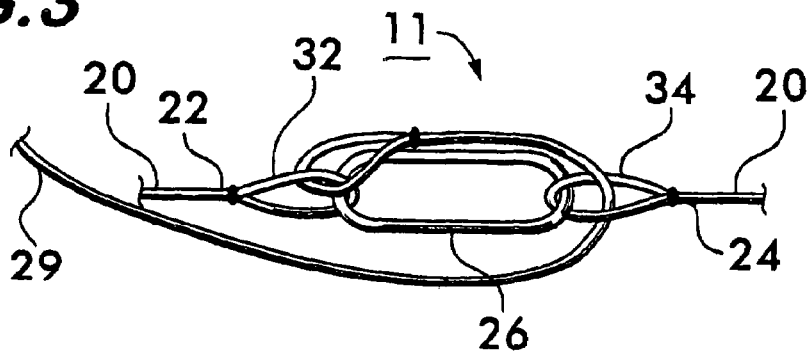
FIG. 3 is a side view of a pre-failure warning indicator in accordance with the present invention.

Referring now to FIG. 3, the pre-failure warning indicator 11 in accordance with the present invention is illustrated in side view and is shown without the cover 25 and without core 12. In a preferred embodiment, the sling 10 may be manufactured with only a pre-failure warning indicator 11, or with both a pre-failure warning indicator 11 and a tamper-evident means 35. Initially, the operation of the pre-failure warning indicator 11 will be disclosed; the tamper-evident means 35 will be described later with respect to FIG. 7.

A separate (preferably single) strand 20 of yarn is dedicated to the pre-failure warning indicator 11. The dedicated warning strand 20 is located within cover 25; it is preferably placed proximate the core 12 and may either be twisted around the load-bearing strands of the core 12 or it may just lay next to the core 12, as illustrated in FIG. 2.

In a different embodiment, it may be desired to permanently affix the dedicated strand 20 to the inside of the cover 25. When a sling is used over a period of time, the cover will develop wear points at specific locations, for example, where the sling hangs from a crane's hook. Accordingly, it is usually advisable to rotate the cover with respect to the load-bearing core 12. By securing the dedicated strand 20 to the inner cover, movement of the cover (either intentionally or non-intentionally) will not affect the operation of the pre-failure warning indicator 11.

First end 22 and second end 24 of the dedicated strand 20 are terminated in eyes 32, 34, respectively. The dedicated strand 20 and eyes 32, 34 are preferably made of the same material as the core strands 17.

The eyes 32, 34 are connected by a ring 26, thereby forming an endless loop with the dedicated strand 20. The shape of the separate dedicated strand 20 generally matches the shape of the endless parallel loops formed by the core strand 17 (i.e., generally circular or oval). Although the term "ring" implies a circularly-shaped object, as used herein "ring" is defined as any closed link or band that will connect the ends of a dedicated strand.

In one preferred embodiment, the ring 26 is chosen to have a lower tensile strength than the core 12. The sling manufacturer may choose to do this any number of ways, e.g., by making the ring 26 out of a different material than the dedicated strand 20, cutting a notch or notches in the ring to physically weaken it, or by making the ring 26 out of the same material as, but of a smaller diameter than, the core strands 17. When ring 26 is chosen to have a lower tensile strength, the pre-failure warning indicator 11 is designed to trigger and thereby notify the rigger or other users of the sling that the sling 10 has been subjected to an overload condition (i.e., the sling was subjected to a force that was pre-determined to compromise the integrity of the sling, and is sometimes determined to be about four times greater than the sling's rated capacity).

Attached to first termination eye 32 is a warning indicator fiber 29. Warning indicator fiber 29 is an elongated strand that is placed substantially parallel to the ring, is threaded through the second termination eye 34, is then double-backed along the ring 26 towards the first eye 32, and directed out an opening in the sling cover 25. (The external end 40 of the warning indicator fiber 29 that extends through the sling cover 25 is sometimes referred to as a "whip.") Although the sling cover 25 is not shown in FIG. 3, the preferred orientation of the warning indicator fiber 29 is illustrated, i.e., it forms a substantially "J" shape within the sling cover 25.

Referring again to FIG. 1, the whip 40 of the warning indicator 29 extends freely through cover 25. Although not necessary, cover patch 30 may be attached (preferably by sewing), to the cover to protect the opening through which the whip end 40 of the warning indicator 29 extends.

The dedicated strand 20 is preferably made of similar material as the strands 17 of the load-bearing core 12; this promotes the relatively equal stretching of all components of the sling 10. In a preferred embodiment, the ring 26 has a pre-selected lower tensile strength than the material used to make the core strands; in this embodiment, the ring 26 will fail before the lifting core 12 is stretched or fatigued. Alternatively—or in addition—the ring 26 may be designed to have a lower resistance to abrasion, heat, cold, and/or chemical exposure. By carefully choosing the properties of ring 26, a sling manufacturer can control the condition(s) under which the subject pre-failure warning indicator 11 will trigger.

In one example, the sling manufacturer may design the ring 26 to fail at 70% of the tensile strength of the inner core. Accordingly, the material from which ring 26 is made and/or its cross-sectional thickness may be chosen to meet the pre-selected tensile strength.

When the sling 10 is placed under a load that exceeds its recommended rating, ring 26 will fail before damage can occur to either the load bearing core strands 17 that form the core 12 or the dedicated strand 20. When ring 26 fails, the termination eyes 32, 34 begin moving in opposite directions away from each other, and the physical distance between the eyes 32, 34 and/or ends 22, 24 of the dedicated strand 20 increases.

As the eyes 32, 34 move apart, the whip portion 40 of warning indicator fiber 29 (i.e., the end that extends freely outside the cover 25) is drawn back inside the cover 25 until it no longer extends through the cover. If the whip end 40 of the warning indicator 29 is not visible, an inspector or rigger will immediately be able to determine that the sling 10 may have been subjected to a condition that would prevent the lifting core 12 from lifting its maximum rated load and will therefore remove the sling 10 from service for further inspection. The double-back configuration of the indicator fiber 29 ensures that the whip end 40 moves twice the distance compared to the distance the eyes 32, 34 move apart, ensuring that every time a trigger event occurs, the whip end 40 will completely disappear. (It should be noted that the whip end 40 of the warning indicator 29 may be shaded in a high visibility color or otherwise marked, so that its visibility or lack thereof will be more noticeable.)

An important feature is that the ring 26 is designed to fail before damage occurs to the lifting core, thereby warning the riggers that they must either stop using the sling 10 in the manner in which they are using it or, if they continue, the sling 10 will be permanently damaged. If the rigger stops using the sling, the integrity of the lifting core 12 may remain intact. In this case, the sling 10 can be returned to the manufacturer and the pre-failure warning indicator 11 can be replaced or repaired; usually only the ring 26 will have to be replaced.

A primary advantage of the pre-failure warning indicator 11 in accordance with this invention is that the ring 26 may be designed to more precisely fail at a controlled point (regardless of whether it is at a specific strength, abrasion, temperature, etc.). The ring 26 can be used as an indicator of an overload condition by making it weaker than the individual core strands 17. In a second embodiment, the ring 26 can be made from a material that would fail from yarn-on-yarn abrasion damage. In a third embodiment, the ring 26 can be made to fail from excessive temperatures (either heat or cold, or both). In a fourth embodiment, the ring 26 could be made from a material that would deteriorate in the presence of chemicals at a concentration lower than would damage the strands 17 of the load-bearing core. In still another embodiment, the ring 26 can be made of a material or combination of materials that would fail when subjected to more than one of the pre-determined conditions (e.g., overload and excessive heat).

In all of the above conditions, the ring 26 is preferably designed to fail at the pre-determined or desired condition at a relatively precise point. For example, if the sling is rated to lift 6,000 pounds (with a five-to-one design factor), the ring 26 can be designed to break relatively close to 24,000 pounds every time. Therefore, the ring 26 can be made to fail before the built-in safety factor of 30,000 pounds and well before any damage occurs to the sling 10. The use of the predictable pre-failure warning indicator 11 as disclosed herein, gives a sling manufacturer a more predictable and accurate way of incorporating a failure notification means into any sling it designs or makes. In other words, the present invention introduces a degree of predictability into the manufacturing of roundslings since the failure point of the ring 26 can be selected and consistently reproduced. In prior art tell-tail indicators, the failure point was unpredictable and was not consistently reproducible.

A prototype was made in order to meet the following requirements:

Tensile strength of 30,000 lbs.;

Vertical Rated Capacity=6,000 lbs. at a 5 to 1 design factor;

Overload Warning Indicator triggers at 20,000-25,000 lbs. with a Design Factor between 3 & 4 to 1;

Lightweight: 6' prototype weighs 1.7 lbs;

Double contrasting color cover: Outer Green and inner Red for easy cut inspection;

Low stretch;

Impervious to salt water and most chemicals including oil, diluted acids and bases;

Made with K-Spec® proprietary blend of high performance core yarn.

The above prototype was tested and it was determined that the whip 40 of the pre-failure warning indicator 11 consistently disappeared (meaning that ring 26 consistently broke) at between 23,000 and 24,000 lbs and the final tensile strength of the sling 10 was 32,860 lbs.

When the whip 40 of the warning indicator 29 is no longer visible, the sling 10 should be returned to the sling manufacturer for inspection and/or repair. The ring 26 consistently broke before damage occurred to either the dedicated strand 20 or the load-bearing core 12. In many cases, the sling manufacturer will only have to replace the ring 26 in order to refurbish the sling and return it service. (In the above example, the ring 26 failed around 24,000 pounds and the sling 10 did not approach its maximum tensile strength of 30,000 pounds.) Under certain conditions, even though the ring 26 may have been designed to fail first, the sling 10 may have degraded to a point where it must be discarded entirely. For example, if the sling 10 was exposed to an acidic environment for an extended period of time, especially after the ring 26 failed, the sling 10 (and, specifically, the strands 17 that make up the load-bearing core) may have been damaged to such an extent that it can no longer meet its rated capacity. (The selection of the material for the core is the primary factor in determining whether the subject sling is impervious to sea water, oil, acids and other chemicals. Also, the cover 25 plays an important factor in protecting the core especially from abrasion or from sharp edges.)

It should be noted that a person skilled in the art, after reading the present disclosure could produce equivalent embodiments. For example, even though virtually all synthetic slings have a load-bearing core protected by an outer cover, a sling manufacturer can eliminate the outer cover (or shorten the outer cover) so that the ring 26 is visible. In this embodiment, a dedicated strand is not required and an operator can determine that a sling overload condition (or other failure condition) was met by observing the integrity of the ring 26.

Figure 4:
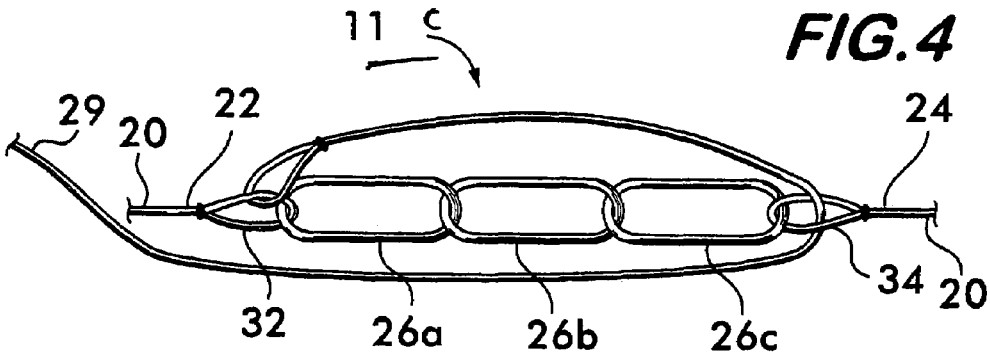
FIG. 4 is a side view of another embodiment of a pre-failure warning indicator in accordance with the present invention, utilizing multiple rings linked together.

Referring now to FIG. 4, another preferred embodiment is disclosed. In this embodiment, pre-failure warning indicator Ha incorporates a plurality of rings 26*a*, 26*b*, 26*c*, etc. connected together (i.e., as links in a chain) between termination eye 32 and termination eye 34. In this manner, a sling 10*a* can be designed to indicate whether it has been subjected to multiple excessive conditions—any one of which could cause the controlled destruction of one of the linked rings 26*a*, 26*b*, 26*c*, etc. and which would then trigger the warning indicator 11*a* in a similar manner as when there is only one ring 26. (Although this example uses three rings 26*a*, 26*b*, and 26*c*, two rings, four rings or more rings may be used depending on the number of failure conditions the sling manufacturer wishes to incorporate into the sling.)

The warning indicator fiber 29 has a secured end and a whip end. The secured end is attached to one termination eye 32; the remainder of the indicator fiber 29 is placed along all of the rings 26*a*, 26*b*, 26*c*; the indicator fiber is then threaded through the other termination eye 34, is double-backed along all the rings, and is finally directed through the slit in the cover 25 where the whip is visible to an operator.

For example, as shown in FIG. 4, ring 26*a* could be designed to fail when the sling is subjected to an overload (excessive weight) condition, ring 26*b* could be designed to fail under an excessive heat condition, and ring 26*c* could be designed to fail when exposed to a specific concentration of a particular chemical. Therefore, if the sling is subjected to any of the pre-determined failure conditions, one of the rings 26*a*, 26*b*, 26*c* will fail, causing the termination eyes 32, 34 to pull away from one another, thereby causing the whip portion 40 of the warning indicator whip 29 to completely retract inside the cover 25. In this manner, a single predictable pre-failure warning indicator 11*c* can be used to signal one of a multiple possible failure conditions. By marking the individual rings before assembly of the sling, one can determine the exact condition which the sling was subjected to that caused the pre-failure warning indicator to trigger. So, for example, if ring 26*b* failed (and ring 26*a* and ring 26*c* remained intact), the sling manufacturer would know that the sling was subjected to a high temperature for an extended period of time.

An improved synthetic roundsling having multiple cores is manufactured by Slingmax, Inc. and is disclosed in U.S. Pat. No. 4,850,629 to Dennis St. Germain. An embodiment disclosed in U.S. Pat. No. 4,850,629 is a two-core roundsling (sold under the brand name TWIN-PATH®) which has two-load lifting cores inside a single cover. The cover is also divided into two separate paths. U.S. Pat. No. 4,850,629 is incorporated by reference as if fully set forth herein.

Figure 5:
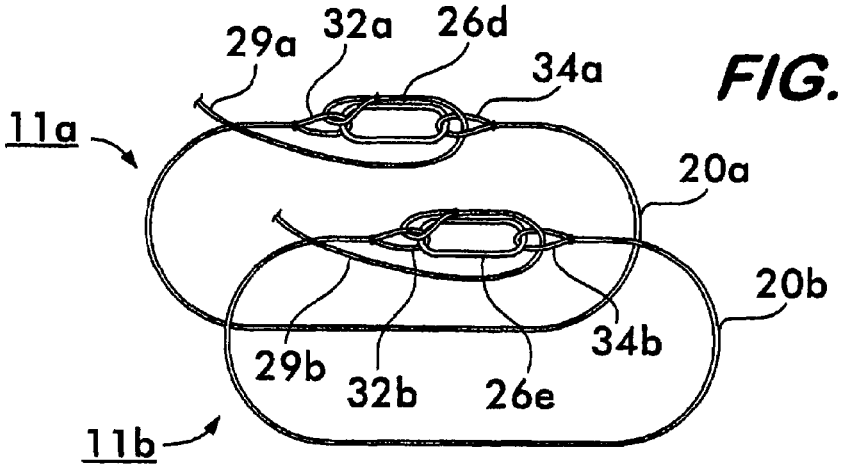
FIG. 5 is a side view of another embodiment of a pre-failure warning indicator in accordance with the present invention for use with a two-path sling.

Similar to a sling having a single core (and a single pre-failure warning indicator), in a multiple-core or multiple-path roundsling 50, each core incorporates a predictable pre-failure warning indicator 11*a*, 11*b*, as taught herein. Referring now to FIG. 5, a first dedicated strand 20*a* is associated with the first core 12*a* of a two-path sling 50 and a second dedicated strand 20*b* is associated with the second core of the two-path sling. The dedicated strand 20*a* is terminated by termination eyes 32*a*, 34*a*, and dedicated strand 20*b* is terminated by termination eyes 32*b*, 34*b*, respectively. A ring 26*d*, 26*e*, as disclosed previously in a one-path sling 10, is incorporated into each path of the two-path sling 50.

Figure 6:
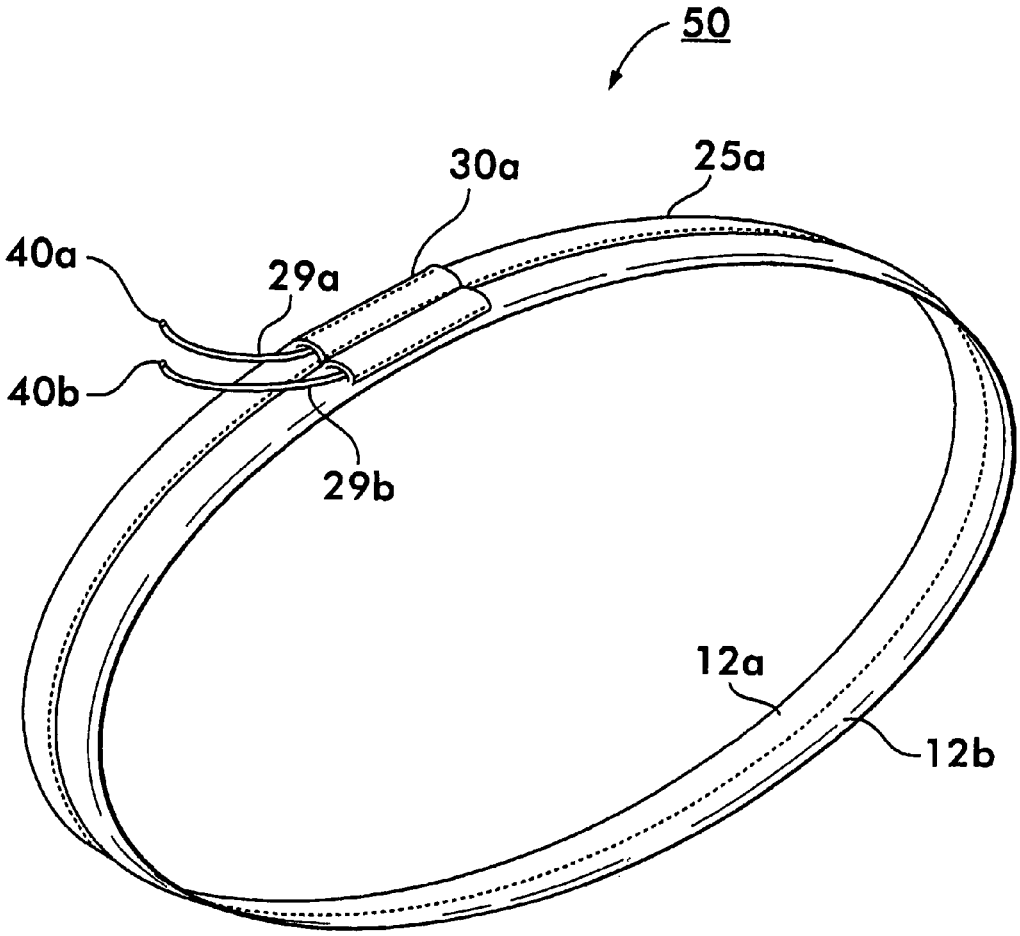
FIG. 6 is a perspective view of a two-path sling incorporating the pre-failure indicator of FIG. 5.

Referring now to FIG. 6, whip 40*a* is associated with the predictable pre-warning indicator 11*a* in the first path of the sling 50, and whip 40*b* is associated with the predictable pre-warning indicator 11*b* in the second path. (It should be noted that the warning indicator fiber 29*a* is attached to one termination eye 32*a*, threaded through the other termination eye 34*a*, and the whip end 40*a* is passed through the cover 25*a*, and operates in a similar manner as the "basic" single-path sling 10 illustrated in FIGS. 1 through 3 using only one ring 26. Similarly, warning indicator strand 29*b* is attached to one termination eye 32*b*, threaded through the other termination eye 34*b*, and the respective whip end 40*b* is passed through the cover, and operates in a similar manner as when there is only one ring 26.)

Sling 50 is comprised of a two-path core; as illustrated in FIG. 6 the warning indicator whips 40*a* and 40*b* are passed through the cover 25*a* and emerge in free extension apart from the cover 25*a*. This embodiment provides a pre-failure indicator for each path that can convey sling damage or overload when either core of the TWIN-PATH® sling is subjected to a load which exceeds its tensile strength or rated capacity. When this happens, one or both of the extended warning indicator whips, 40*a* and/or 40*b*, which emerge outside of the cover material 25*a* will retract completely within the cover thereby alerting the operator or rigger to a sling overload condition.

In a Twin-Path® sling having exactly two cores, each core is identical to the other. Referring again to FIG. 5, an interesting variation for a two-core sling is the ability to design into the sling two distinct and separate damage-indicating parameters into a single sling. For example, in the first path, the ring 26*d* could be designed to fail only at a lower tensile strength than the core 12; while in the second path, the ring 26*e* could be designed to fail only when the sling is exposed to a certain chemical in the environment. The whips 40*a*, 40*b* of warning indicators 29*a* and 29*b* can be marked or coded in order to indicate which whip is associated with which ring so that if a ring breaks, the rigger will know the condition that was exceeded (i.e., if ring 26*d* breaks it was because the TWIN-PATH® sling was subjected to a load approaching it's maximum load rating; alternatively, if ring 26*e* breaks if was because the TWIN-PATH® sling was exposed to the chemical for a period of time such that it deteriorated the integrity of the sling). Therefore, if a three-core sling is made, three separate conditions may be simultaneously and independently tested using the predictable pre-failure indicator 11 taught herein; a four-core sling can be used to simultaneously test for four separate conditions, etc.

In this manner, if the two-path sling 50 is subjected to either one of the pre-selected conditions to a point that causes either ring 26*d* or ring 26*e* to fail, the rigger will be alerted and will have more information than would otherwise be available to him. Designing the rings 26*d*, 26*e* to fail under different situations may also assist the sling manufacturer in analyzing the sling or further improving the sling, if the sling is ever returned for inspection or repair. However, there are situations in which it will be necessary to design the rings 26*d* and 26*e* to fail under the same condition (e.g., an overload condition).

The pre-failure warning indicator 11 in accordance with the present invention is designed with a trigger mechanism that will generate a magnified force on the whip end 40 of the external warning indicator 29 in order to move the whip end 40 out-of-sight almost instantaneously, if any of the pre-engineered conditions are met and the ring fails. The reason why the force on the whip end 40 of the warning indicator fiber 29 is magnified is because of the double-back design of the warning indicator fiber 29 through the termination eyes 32, 34. After the ring 26 breaks, the termination eyes 32 and 34 separate at a certain speed; however, since the warning indicator fiber 29 is tied to one eye 32, threaded through the opposite eye 34, and doubles-back along the ring before emerging through the cover 25, the whip end 40 of the warning indicator is moving twice as fast (and twice the distance) as the speed (and distance) at which the eyes 32, 34 are moving away from each other. Accordingly, the whip end 40 withdraws inside the cover entirely so that there is no question as to whether a trigger event occurred.

Another feature to note, is that because the whip 40 of the warning indicator 29 is moving so fast, it creates a sound that is audible to the operator. Therefore, the present invention not only gives a visual indication that a sling has reached a critical damage point, but also gives an audible warning. The audible warning is especially important when the sling is positioned so that the operator cannot see the whip 40 (e.g., when the sling is hanging thirty feet in the air).

Another notable feature of the subject pre-failure warning indicator 11 is the ability to warn the rigger of an overload and other dangerous situations without affecting the overall strength of the roundsling 10. If the rigger stops lifting the load promptly after the pre-failure warning indicator 11 is triggered, the sling 10 retains 100% of its residual strength.

The color code safety feature of this invention may be achieved by encasing the load-bearing core in two separate covers, each cover having a different color. For example, the outer cover could be green or blue, and the inner cover could be orange or red; since the inner cover is a different color from the outer cover, it will show through whenever the outer cover is cut or worn through. This double-cover feature provides a visible safety warning for any user of the sling that abrasion or other damage not normally detectable, has occurred.

Figure 7:
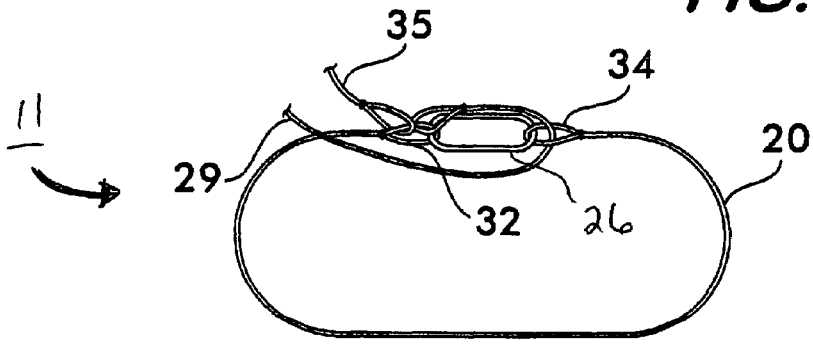
FIG. 7 is a side view of a pre-failure warning indicator in accordance with the present invention which also incorporates a sabotage indicator means.

In another embodiment of the present invention, a pre-failure warning indicator 11 can be adapted with a sabotage or tamper-evident means. Referring now to FIG. 7, a tamper-evident tag 35 is attached to either the dedicated indicator strand 20 or, preferably, to one of the eyes 32 or 34. The free end of the tamper-evident tag 35 is passed through the cover via a slit. The slit can be the same one through which the whip 40 passes through.

Figure 8:
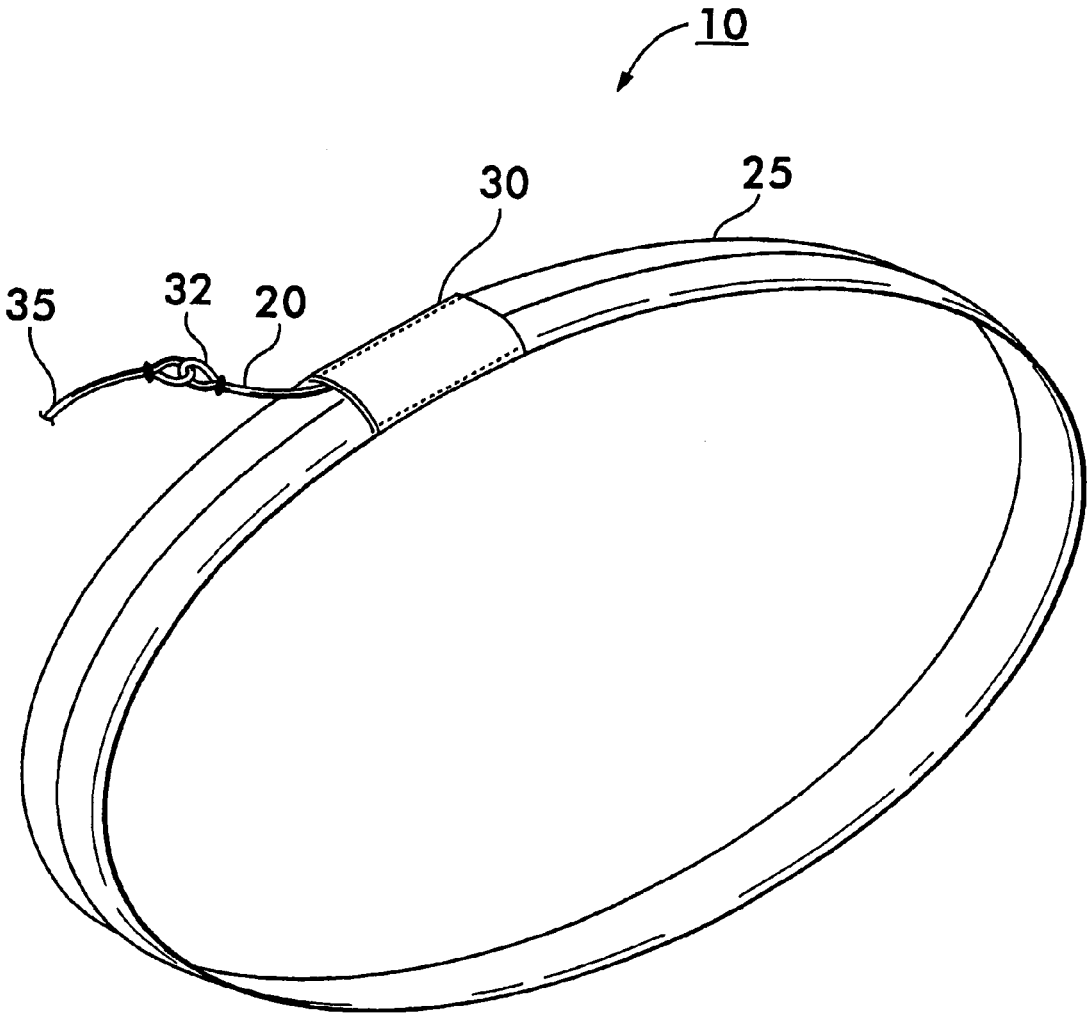
FIG. 8 is a perspective view of a single-path roundsling incorporating the predictable pre-failure warning indicator of FIG. 3 and the sabotage indicator of FIG. 7.

If the pre-failure warning indicator 11 is triggered (by, for example, an overload condition), this means that ring 26 has been broken, the ends 22, 24 of the dedicated strand 20 are free, causing whip 40 to withdraw completely within the cover. Upon inspection, the tamper-evident tag 35 can be easily pulled out from inside the cover 25 along with a portion of the dedicated strand 20, as illustrated in FIG. 8, when the pre-failure warning indicator 11 has been triggered. If the whip end 40 of the warning indicator is not visible because of an intentional intervention by a user, the tamper-evident tag 35 will remain secure and cannot be pulled from the cover 25. In this manner, sabotage of the sling 10 can be evidenced by the supervisor on the work site. (In order to avoid work, some users will cut off the whip end 40 of the warning indicator 29 in an attempt to make it appear that the sling was subjected to a damage situation and, therefore, work must be temporarily stopped so that the sling can be removed for inspection and, if necessary, replaced with a new sling.)

As part of the inspection process, the inspector may yank on the tamper-evident tag 35. If the tag is secure, the sling 10 is useable; but, if the tamper-evident tag 35 can be pulled out from inside the cover, the sling 10 must be removed from use because the pre-failure warning indicator 11 has been triggered. Of course, if a saboteur cuts both the whip end 40 and the visible portion of the tamper-evident tag 35, the inspector will immediately know that the sling 10 has been tampered with, and should remove the sling from service.

It is important to note that no other prior warning indicators have the ability to quickly inspect the condition of a roundsling. Also, prior warning indicators are not as accurate as the subject warning indicator 11. If the whip end 40 of the warning indicator is visible and the cover 25 is intact, the roundsling can be used for the next lift; if the whip end 40 of the warning indicator is not visible, the sling should be removed from service and inspected. The subject pre-failure warning indicator is the first completely pass/fail inspection system—it is a completely objective test and not subjective.

It should also be noted that one skilled in the art, after reading this disclosure, may develop variations that are contemplated as being equivalent in scope to the various embodiments specifically set forth in the present disclosure. For example, the termination loops 32, 34 may be eliminated and the ends of the dedicated strand 20 may be tied directly to the ring 26. (Alternatively, slip-knots or other means may be used to secure the ends of the strand 20 to the ring 26.) Although this invention has been described and illustrated by reference to specific embodiments, it will be apparent to those skilled in the art that various changes, modifications and equivalents may be made which clearly fall within the scope of this invention. The present invention is intended to be protected broadly within the spirit and scope of the appended claims.

I claim:

1. A roundsling which comprises:

a) a load-bearing core;

b) a pre-failure warning indicator means including:

i) a strand, having a first end terminated by a first eye and a second end terminated by a second eye, said strand placed proximate the lifting core;

ii) a ring adapted to join said eyes to form an endless loop of the strand, wherein said ring is designed to fail from one or more predetermined conditions and said failure occurs before said lifting core is damaged; and iii) a warning indicator fiber having a secured end and a whip end, the secured end of said warning indicator being attached to the first eye of the strand, and the whip end of said warning indicator fiber being directed along the ring, threaded through the second eye of said strand and double-backed along the ring; and c) a cover means for covering the lifting core and the pre-failure warning indicator, said cover having at least one slit from which said whip end of the warning indicator fiber emerges and extends so that the whip end is visible upon a cursory inspection.

2. The roundsling of claim 1 wherein said ring has a lower tensile strength than the load-bearing core.

3. The roundsling of claim 2 wherein said ring fails at a pre-determined force well before damage can occur to the load-bearing core, said ring failure causing the first eye and second eye to separate with respect to each other and drawing the whip end of the warning indicator inside the cover so that it is no longer visible.

4. The roundsling of claim 2 wherein when the roundsling is subjected to a force of approximately 70% of its rated maximum load, the ring breaks, causing the whip end to withdraw completely inside the cover, thereby providing a visual indication to any observer that the sling has been subjected to a possible overload condition and may have been damaged.

5. The roundsling of claim 3 wherein said whip end of the warning indicator moves so quickly as it withdraws within the cover that it makes an audible indication.

6. The roundsling of claim 1 wherein said ring is more susceptible to break from yarn-on-yarn abrasion damage than the load-bearing core.

7. The roundsling of claim 1 wherein said ring is more susceptible to break from excessive temperatures than the load-bearing core.

8. The roundsling of claim 1 wherein said ring is more susceptible to break from the deterioration of chemicals than the load-bearing core.

9. The roundsling of claim 1 wherein said strand of the pre-failure warning indicator is twisted around the load-bearing core.

10. The roundsling of claim 1 wherein the load-bearing core is formed by twisting a plurality of yarns together to form a single strand and then wrapping the single strand into endless parallel loops.

11. The roundsling of claim 10 wherein said load-bearing core comprises one of the following materials:

a) aramid material strands;

b) K-Spec® A strands (a proprietary blend of high performance fibers);

c) polyester strands;

d) polyethylene strands;

e) HMPE strands; or f) LCP strands.

12. The roundsling of claim 11 wherein said strand of the pre-failure warning indicator is made from the same load-bearing material as the load-bearing core.

13. The roundsling of claim 1 comprising a second cover means that encloses said cover means, said second cover means having a different color than the enclosed cover means.

14. The roundsling of claim 1 further comprising a tamper-evident indication means including a tag having a first end and a second end, the first end of said tag attached to the strand of the pre-failure warning indicator, the second end of said tag threaded through the slit in the cover, the tamper-evident indication means designed to remain stationary as long as the ring's integrity remains intact, and if the sling has been subjected to a pre-determined condition such that the ring breaks, the tamper-evident indication means can be pulled out from inside the cover.

15. The roundsling of claim 14 in which said first end of the tag is attached to an eye of the pre-failure warning indicator.

* * * * *